US012006715B2

(12) United States Patent
Penner

(10) Patent No.: US 12,006,715 B2
(45) Date of Patent: Jun. 11, 2024

(54) GRAVE MARKER SYSTEM WITH CONCEALED TIME CAPSULE

(71) Applicant: Roy M. Penner, Pittsburgh, PA (US)

(72) Inventor: Roy M. Penner, Pittsburgh, PA (US)

( * ) Notice: Subject to any disclaimer, the term of this patent is extended or adjusted under 35 U.S.C. 154(b) by 0 days.

(21) Appl. No.: 17/556,261

(22) Filed: Dec. 20, 2021

(65) Prior Publication Data

US 2023/0193648 A1 Jun. 22, 2023

(51) Int. Cl.
*E04H 13/00* (2006.01)

(52) U.S. Cl.
CPC ..... *E04H 13/003* (2013.01); *E04H 13/001* (2013.01)

(58) Field of Classification Search
CPC ..... E04H 13/00; E04H 13/003; E04H 13/006; E04H 13/008
See application file for complete search history.

(56) References Cited

U.S. PATENT DOCUMENTS 1,274,809 A * 8/1918 Storm ..... E04H 13/003 D99/24
2,120,082 A * 6/1938 Anderson ..... E04H 13/00 52/103
2,124,143 A * 7/1938 Long ..... E04H 13/00 D99/24
2,276,749 A * 3/1942 Vanderveer ..... A47G 7/06 40/124.5
3,001,326 A * 9/1961 O'Brien ..... E04H 13/003 D99/19
3,726,052 A * 4/1973 Thompson ..... E04H 13/003 52/27
3,940,894 A * 3/1976 Nunes ..... E04H 13/008 52/129
4,019,294 A * 4/1977 Bosico ..... E04H 13/003 52/103
4,175,363 A * 11/1979 Moskowitz ..... E04H 13/003 52/592.1
4,304,076 A * 12/1981 Splendora ..... E04H 13/003 40/124.5
4,328,606 A * 5/1982 Nunes ..... A61G 17/007 27/35
5,517,790 A * 5/1996 Jennings ..... E04H 13/003 52/168
5,595,029 A * 1/1997 Revoir ..... E04H 13/003 52/103
5,704,103 A * 1/1998 Crowley ..... E04H 13/003 40/124.5
5,732,515 A * 3/1998 Rodrigues ..... E04H 13/003 52/103
6,092,330 A * 7/2000 Pratt ..... A47G 7/06 47/33

(Continued)

*Primary Examiner* — Kyle J. Walraed-Sullivan
(74) *Attorney, Agent, or Firm* — Nelson Mullins Riley & Scarborough LLP

(57) ABSTRACT

A memorialization grave marker system includes a foundation portion at least partially below ground, a grave marker portion (headstone, footstone or similar item) supported by the foundation portion at least partially above ground. At least one of the foundation portion and the grave marker portion form an internal cavity. At least one weather-tight container or "time capsule" for storing at least one of artifacts, memorabilia, and information is concealed within the internal cavity and accessible to present and future generations.

14 Claims, 14 Drawing Sheets

(56) References Cited

U.S. PATENT DOCUMENTS 6,264,032 B1 * 7/2001 Hobbs ..... E04H 13/003 40/124.5
6,279,212 B1 * 8/2001 Balch ..... E04H 13/008 27/35
6,463,703 B1 * 10/2002 Mattis ..... E04H 13/003 52/103
6,904,721 B1 * 6/2005 Forbes ..... E04H 13/008 52/103
7,861,385 B1 * 1/2011 Meyer ..... A61G 17/08 40/124.5
8,959,731 B2 * 2/2015 Lynch ..... A61G 17/0136 431/291
9,441,393 B1 * 9/2016 Muthusami ..... E04H 13/001
10,233,663 B1 * 3/2019 Grupp ..... E04H 13/003
10,458,144 B1 * 10/2019 Yearick ..... H05B 45/10
2001/0013183 A1 * 8/2001 Yager ..... E04H 13/003 40/124.5
2004/0085337 A1 * 5/2004 Barrows ..... E04H 13/003 715/717
2005/0005409 A1 * 1/2005 Elnatan ..... A61G 17/08 27/1
2006/0123714 A1 * 6/2006 Sannipoli, Sr. ..... E04H 13/003 52/103
2007/0130736 A1 * 6/2007 Trail ..... E04H 13/003 27/1
2007/0217185 A1 * 9/2007 Monahan ..... E04H 13/003 362/145
2008/0028692 A1 * 2/2008 Segura ..... E04H 13/003 52/103
2008/0034648 A1 * 2/2008 Rasmussen ..... E04H 13/003 47/41.1
2008/0198030 A1 * 8/2008 Pringle ..... G08B 13/12 340/687
2008/0229679 A1 * 9/2008 Trail ..... E04H 13/003 52/103
2008/0244994 A1 * 10/2008 Burman ..... E04H 13/003 52/103
2011/0030289 A1 * 2/2011 Rossi ..... E04H 13/006 52/133
2012/0155066 A1 * 6/2012 Carlson ..... F21S 9/037 362/145
2013/0185907 A1 * 7/2013 Langelier ..... A61G 17/08 27/1
2014/0215933 A1 * 8/2014 Carlson ..... A61G 17/0136 52/103
2014/0259983 A1 * 9/2014 Camp, Jr. ..... E04H 13/003 52/103
2015/0128391 A1 * 5/2015 Lynch ..... F21V 35/00 27/1
2017/0041584 A1 * 2/2017 Jones ..... H04N 5/76
2018/0100324 A1 * 4/2018 McFee ..... E04H 13/003
2020/0115918 A1 * 4/2020 Sidhu ..... E04H 13/003
2021/0222453 A1 * 7/2021 Sidhu ..... E04H 13/003
2022/0316229 A1 * 10/2022 Griggs ..... E04H 13/003

* cited by examiner

GRAVE MARKER SYSTEM WITH CONCEALED TIME CAPSULE

CROSS-REFERENCE TO RELATED APPLICATIONS

Not applicable

STATEMENT REGARDING FEDERALLY SPONSORED RESEARCH

Not applicable

PARTIES TO A JOINT RESEARCH AGREEMENT

Not Applicable

REFERENCE TO APPENDIX

Not applicable

FIELD OF THE INVENTION

The present invention is in the technical field of architecture. More particularly, the present invention is in the technical field of design and fabrication of material assemblies (including emerging technologies such as 3d printing) for memorialization grave markers (headstones, footstones, and similar items) and time capsules (and similar items). Even more specifically, the present invention is in the technical field of memorialization grave markers having a time capsule container integrated within the grave marker's structure.

BACKGROUND OF THE INVENTION

Typically, memorialization grave markers, commonly known as headstones and footstones (or similar items) including their supporting structures or foundations are mere markers for the gravesite of a deceased individual being (human or animal) with little or no other utilitarian features. Those among the living visit the gravesite to mourn or pay their respects to the deceased individual whose identity and limited information about the deceased individual is provided on the grave marker.

Memorialization grave markers and their supporting structures are typically designed and fabricated utilizing solid permanent materials which will withstand the test of time such as, for example but not limited to, stone, bronze and concrete (as approved by the burial location). These, typically solid memorialization objects (grave markers) are fabricated without accessible voids and include engravings or castings (or similar items) that identify the deceased person(s) that is buried at that location with words, pictures, relief sculptures, other sculptural elements or similar items.

These memorialization grave markers preserve minimal information (name, birthdate, date of death, family status, etc.) about the deceased person's life for perpetuity. Some individuals, families, friends and associates like to save and secure memorabilia, artifacts and information about themselves, a deceased relative or an associate for long periods of time in order to educate and/or develop a connection with descendants, associates, friends or family in present or later generations. These personal artifacts, memorabilia and information that describe a persons' life, typically end up in a box that resides in a descendant's, associate's, friend's or family's basement or attic and rarely survive intact for many years or generations.

There also exists a tradition of preserving artifacts, memorabilia, and information, about a period of time, in a sealed weather-tight container, for future generations, commonly known as a "time capsule". Time capsules are typically set to be opened in the distant future on a significant date, all determined by the people responsible for obtaining and burying it.

Accordingly, there exists a need for saving and securing memorabilia, artifacts and information about a deceased relative or associate for long periods of time in order to educate and/or develop a connection with descendants, associates, friends or family in present or later generations.

SUMMARY OF THE INVENTION

The present invention addresses at least one of the above-noted problems of the prior art by integrating at least one sealed weather tight "time capsule" container within a memorialization grave marker, including its supporting structures or foundations. The memorialization grave marker is designed to integrate a sealed weather tight "time capsule" container(s) which is concealed within the memorialization grave marker structure (such as, for example but not limited to, a headstone, footstone, and similar items).

Disclosed herein is a memorialization grave marker system comprising, in combination, a foundation portion at least partially below ground, and a grave marker portion supported by the foundation portion at least partially above ground. At least one of the foundation portion and the grave marker portion forms an internal cavity, and at least one weather-tight container is located within the internal cavity for storing at least one of artifacts, memorabilia, and information.

Also disclosed a memorialization grave marker system for a grave, comprising, in combination, a foundation at least partially below ground, and a headstone supported by the foundation above ground. At least one weather-tight container for storing at least one of artifacts, memorabilia, and information is located within an internal cavity. The foundation and the headstone together form the internal cavity. The headstone includes an access panel selectively openable to provide access to the internal cavity.

Further disclosed is a memorialization grave marker system comprising, in combination, a foundation at least partially below ground, and a footstone supported by the foundation above ground. At least one weather-tight container for storing at least one of artifacts, memorabilia, and information is located within an internal cavity. The foundation forms the internal cavity. The footstone includes an access panel selectively openable to provide access to the internal cavity.

From the foregoing disclosure and the following more detailed description of various preferred embodiments it will be apparent to those skilled in the art that the present invention provides a significant advance in the technology and art of memorialization grave markers. Particularly, significant in this regard is the potential the invention affords for providing reliable, convenient and effective systems and methods for securely saving and securing memorabilia, artifacts and information about a deceased relative or associate for long periods of time in order to educate and/or develop a connection with descendants, associates, friends or family in present or later generations. Additional features and advantages of the invention will be better understood in view of the detailed description provided below.

BRIEF DESCRIPTION OF THE DRAWINGS

These and further objects of the invention will become apparent from the following detailed description.

Figure 1:
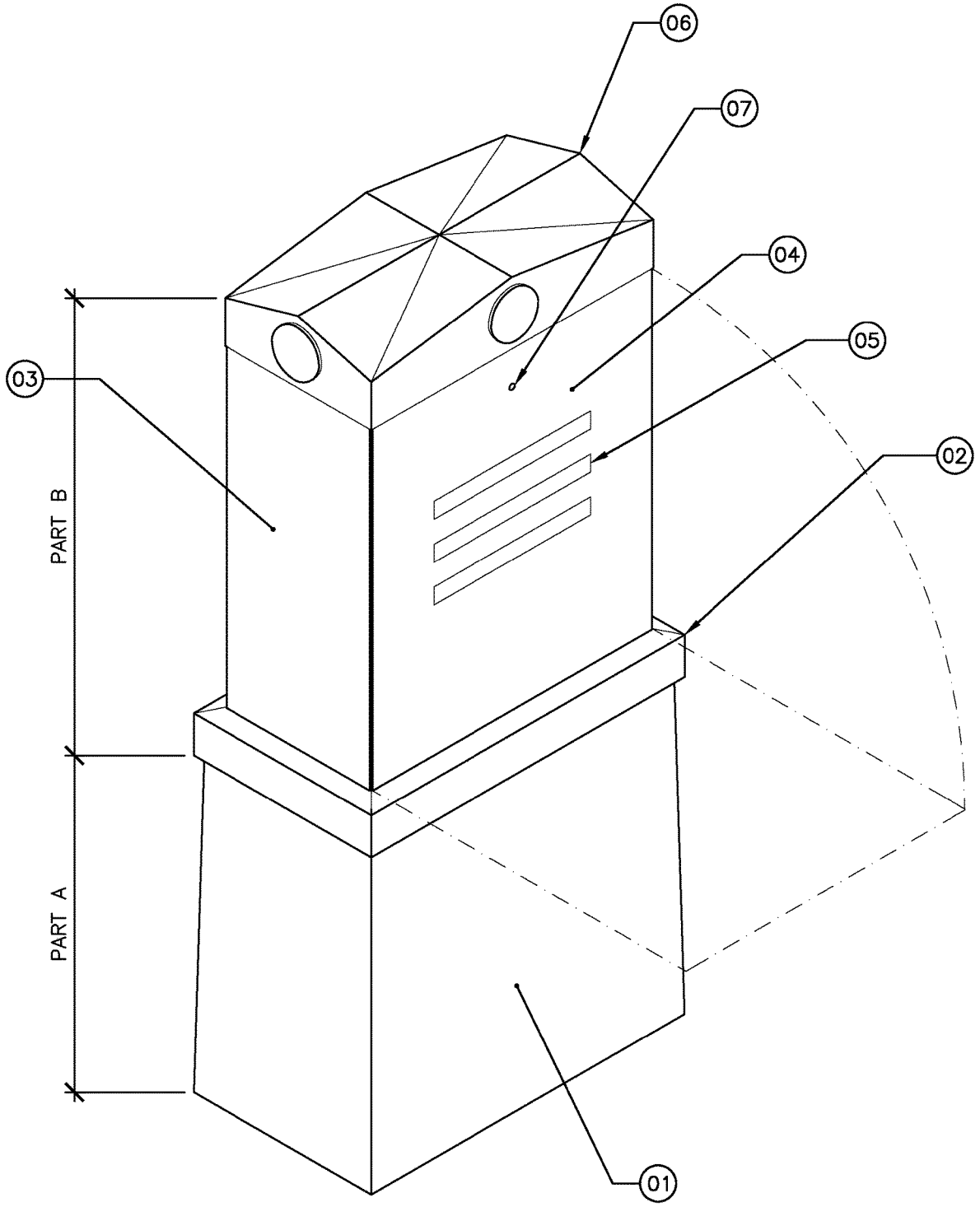
FIG. 1 is a perspective view of an exemplary headstone and foundation structure integrated with a concealed sealed weather-tight container or "time capsule" according to the present invention, wherein the headstone and foundation structure includes a concrete foundation portion (Part A) and a stone upper portion (Part B).
Figure 2:
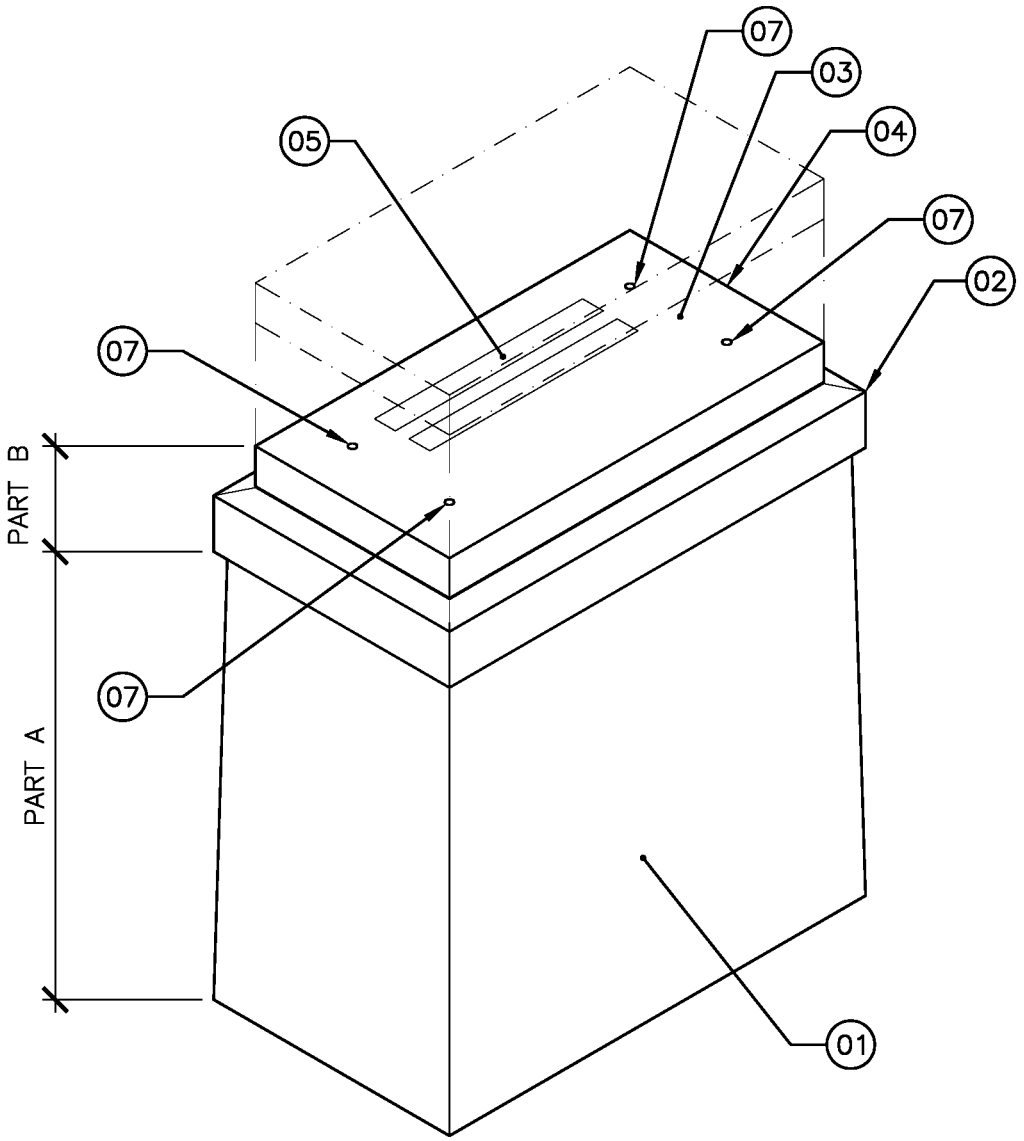
FIG. 2 is a perspective view of an exemplary footstone and foundation structure integrated with a concealed sealed weather-tight container or "time capsule" according to the present invention, wherein the footstone and foundation structure includes a concrete foundation portion (Part A) and a stone upper portion (Part B).
Figure 3:
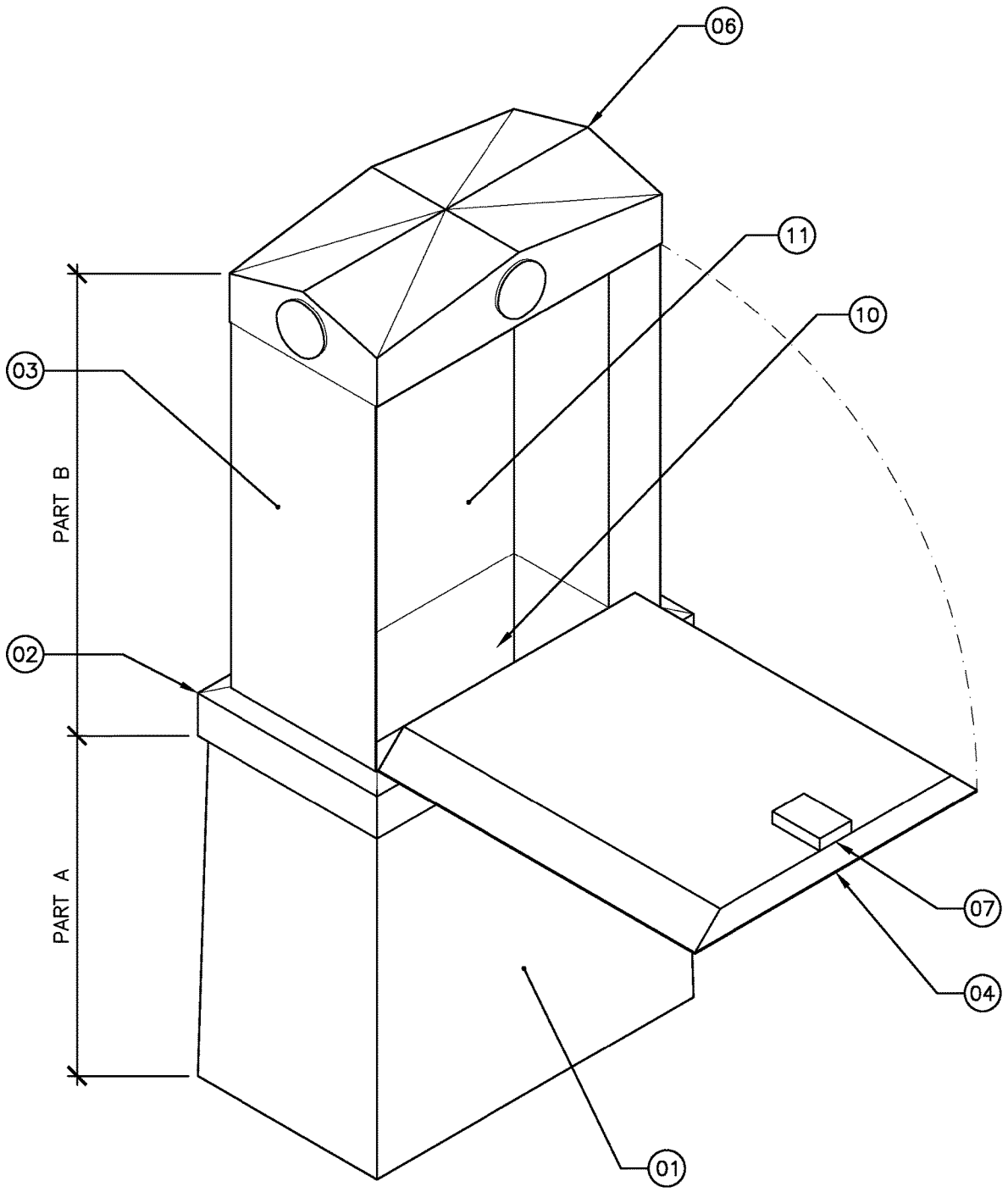
FIG. 3 is a perspective view of the exemplary headstone and foundation structure of FIG. 1, but with an integrated and concealed void area (or hollow interior cavity) revealed by having an access panel removed (or in an open position) for inserting and removing the sealed weather-tight container(s) "time capsule".
Figure 4:
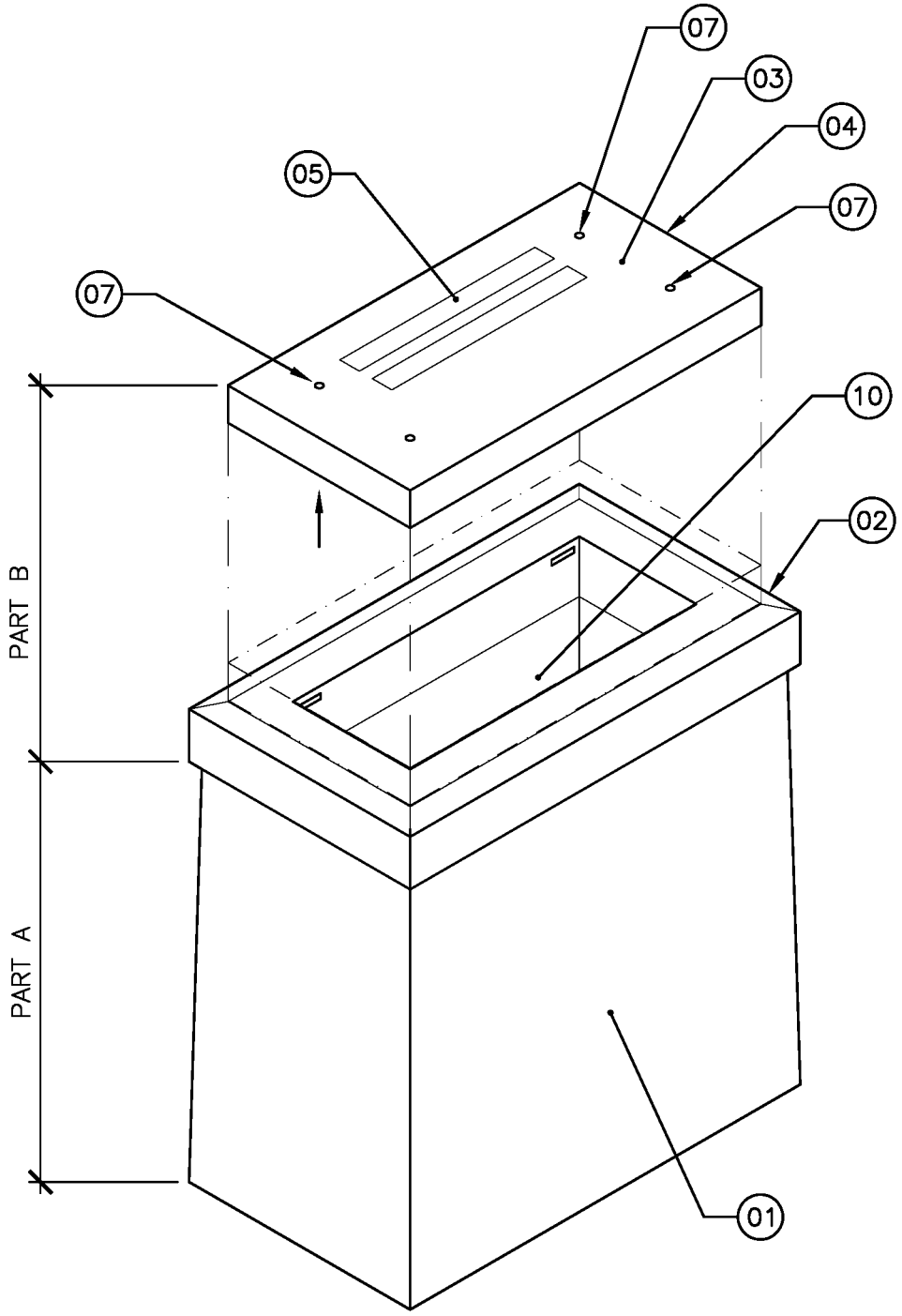
FIG. 4 a perspective view of the exemplary footstone and foundation structure of FIG. 2, but with an integrated and concealed void area (or hollow internal cavity) revealed by having an access panel removed (or in an open position) for inserting and removing the sealed weather-tight container(s) "time capsule".
Figure 5:
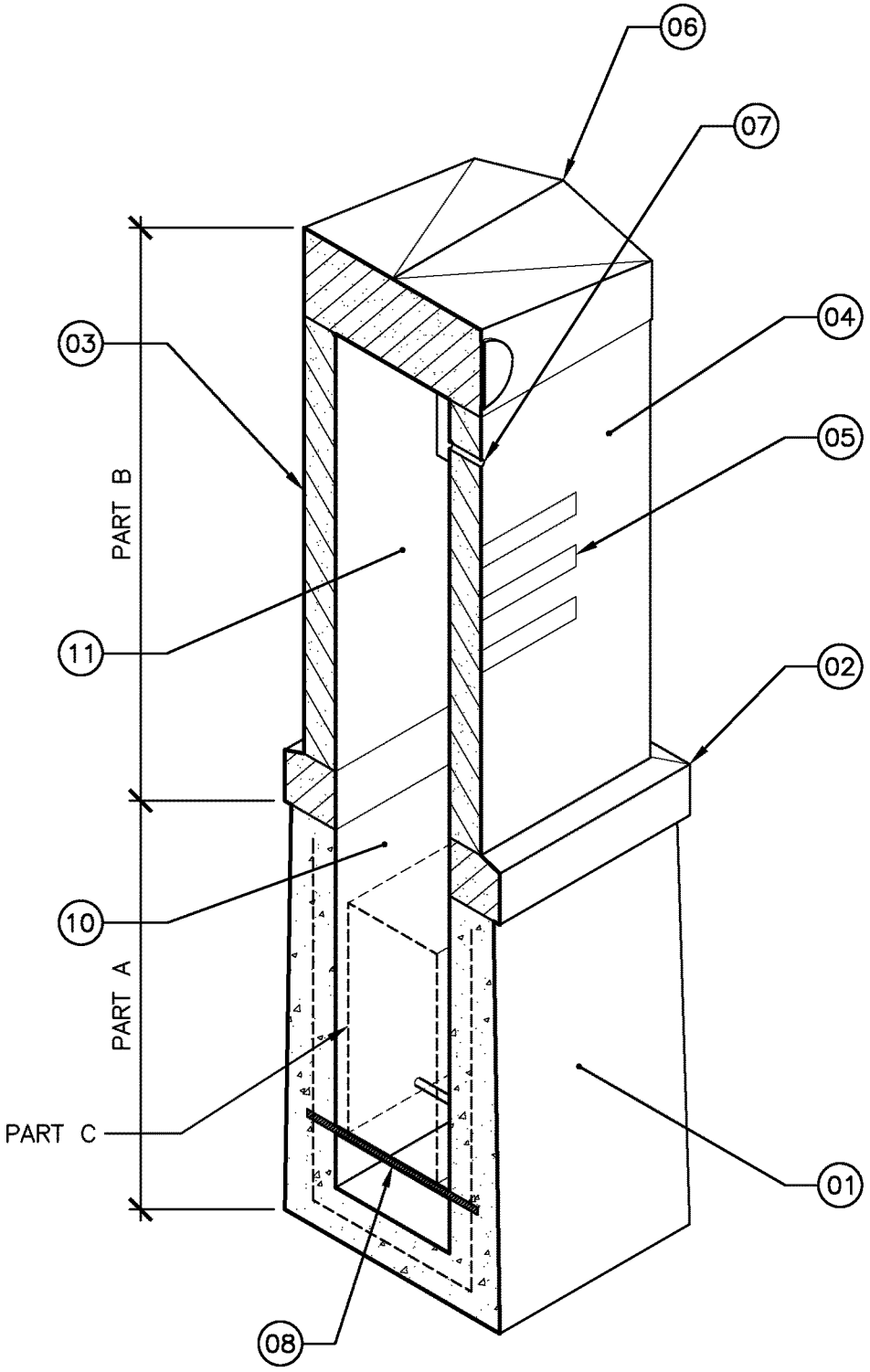
FIG. 5 is a right-side section view cut through a vertical plane centered in the lateral direction of the exemplary headstone and foundation structure of FIGS. 1 and 3, wherein the sealed weather-tight container(s) or "time capsule" (Part C) is within the integrated and concealed void area (or hollow internal cavity).
Figure 6:
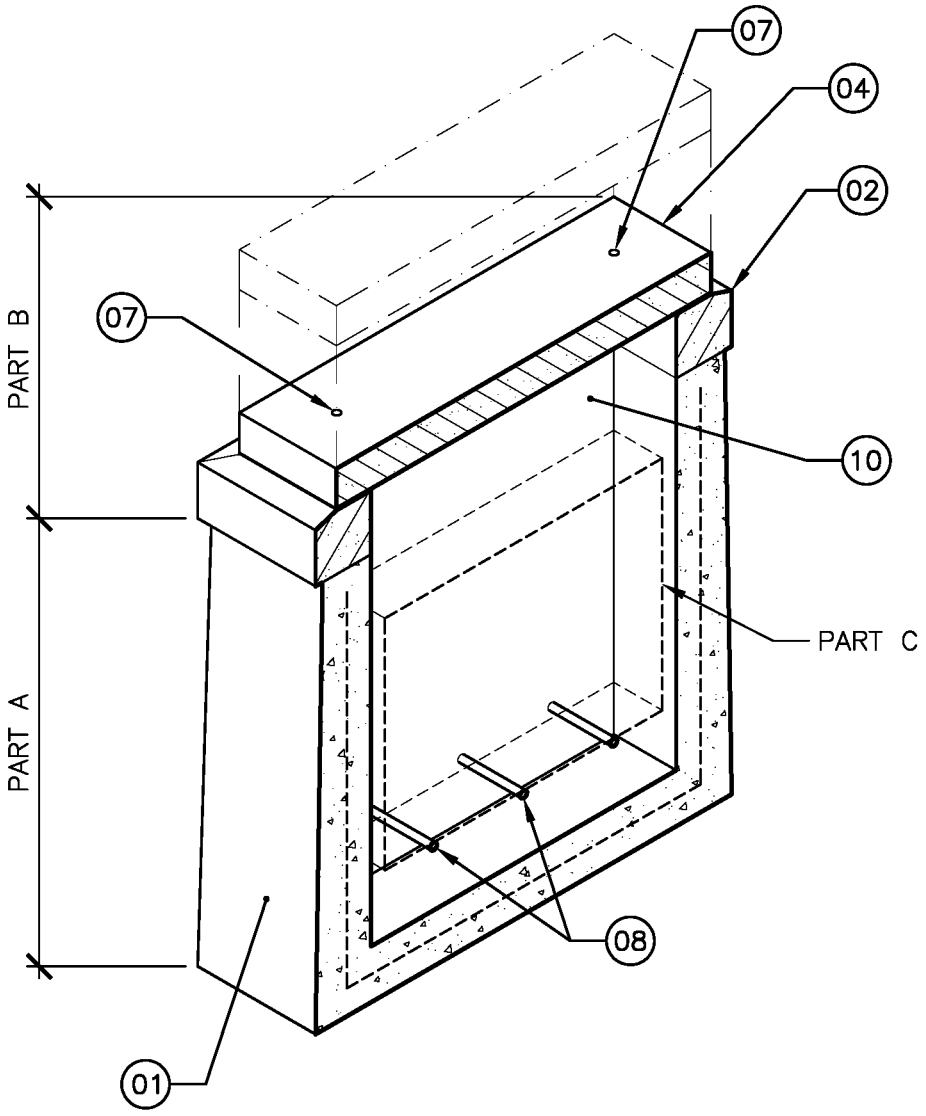
FIG. 6 is a front section view cut through a vertical plane centered in the forward/rearward direction of the exemplary footstone and foundation structure of FIGS. 2, and 4 wherein the sealed weather-tight container(s) or "time capsule" (Part C) is within the integrated and concealed void area (or hollow internal cavity).
Figure 7:
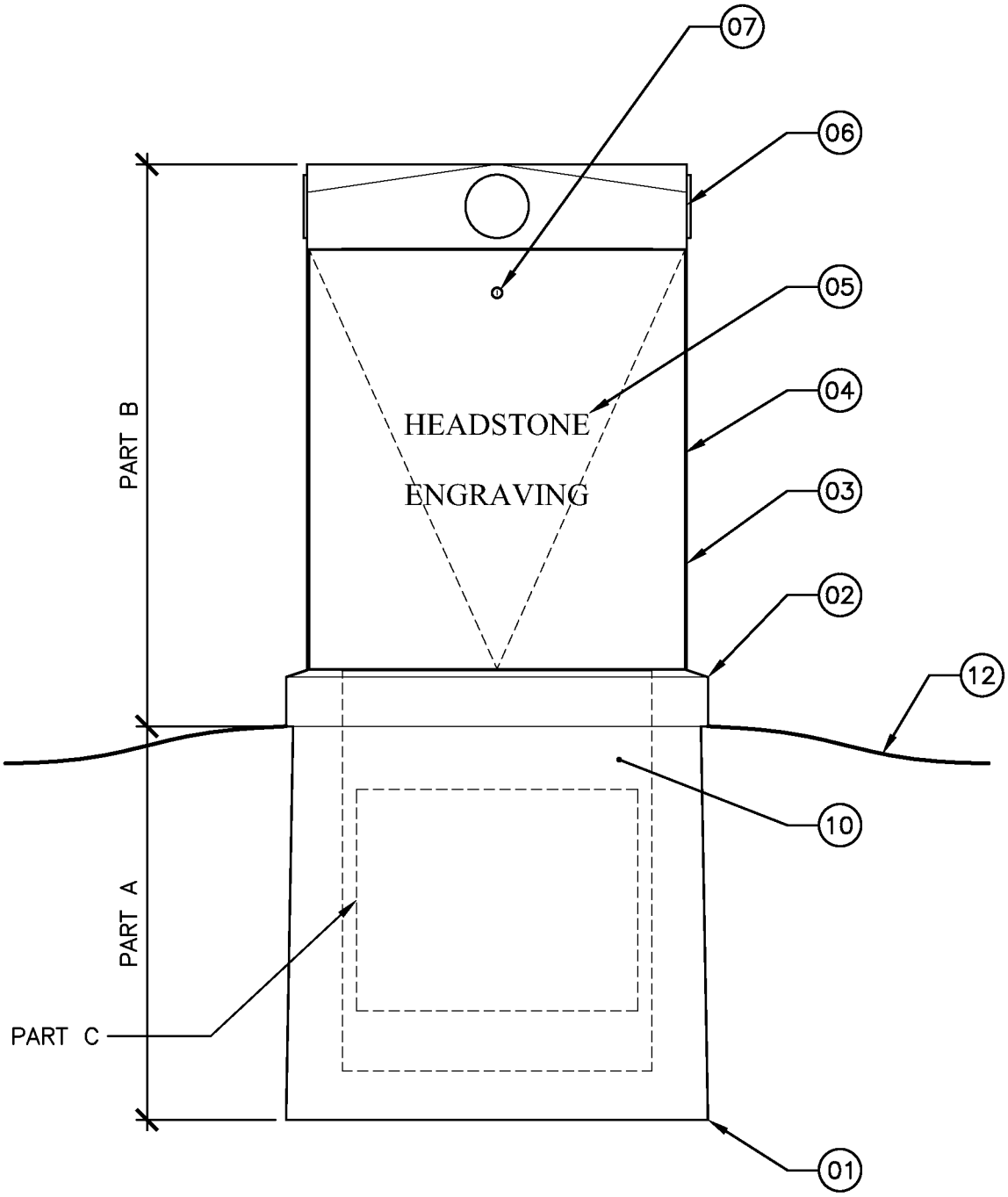
FIG. 7 is a front side view of the exemplary headstone and foundation structure of FIGS. 1, 3, and 5, wherein grade or ground level is shown.
Figure 8:
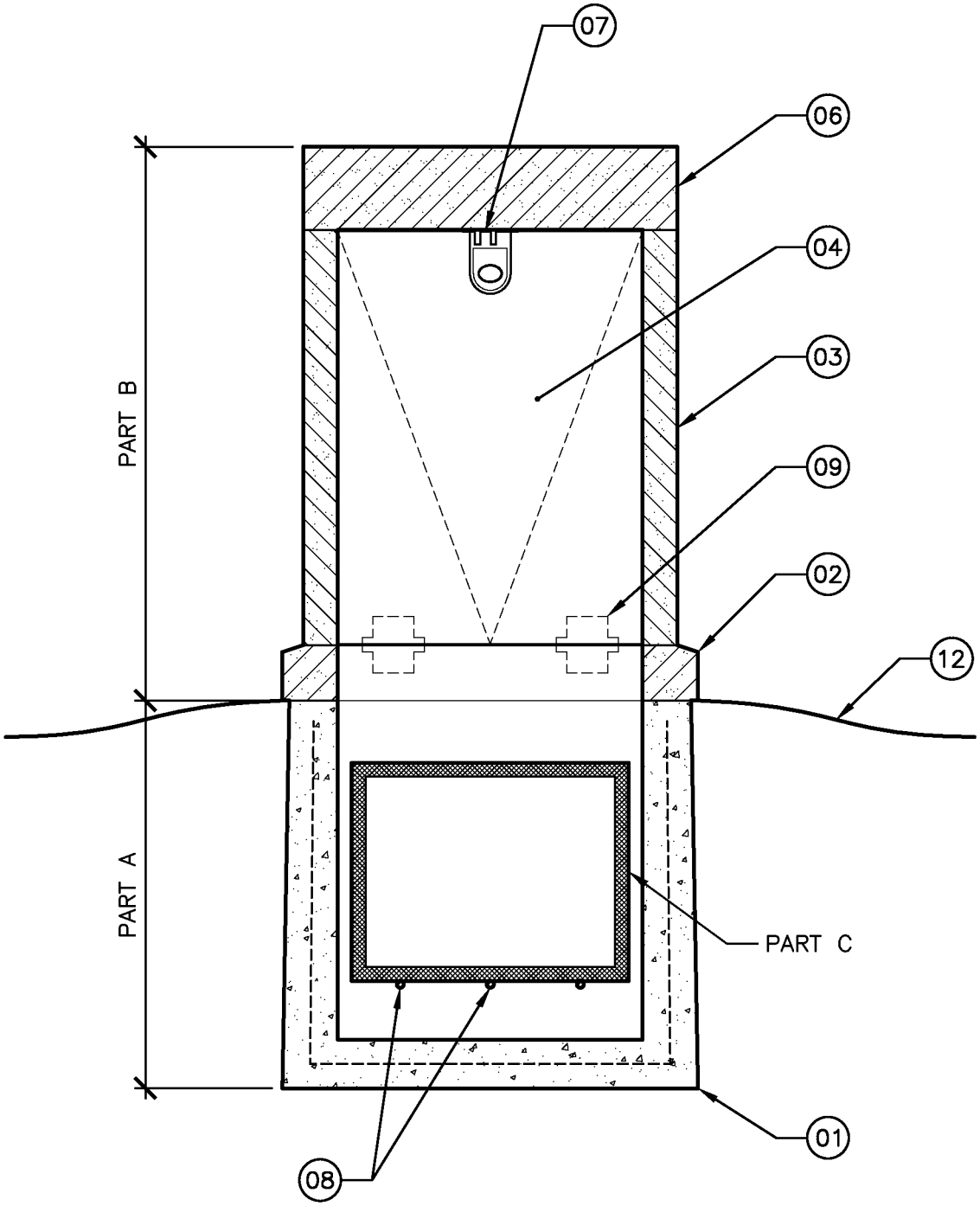
FIG. 8 is a rear section view cut through a vertical plane centered in the forward/rearward direction of the exemplary headstone and foundation structure of FIGS. 1, 3, 5, and 7, wherein grade or ground level is shown.
Figure 9:
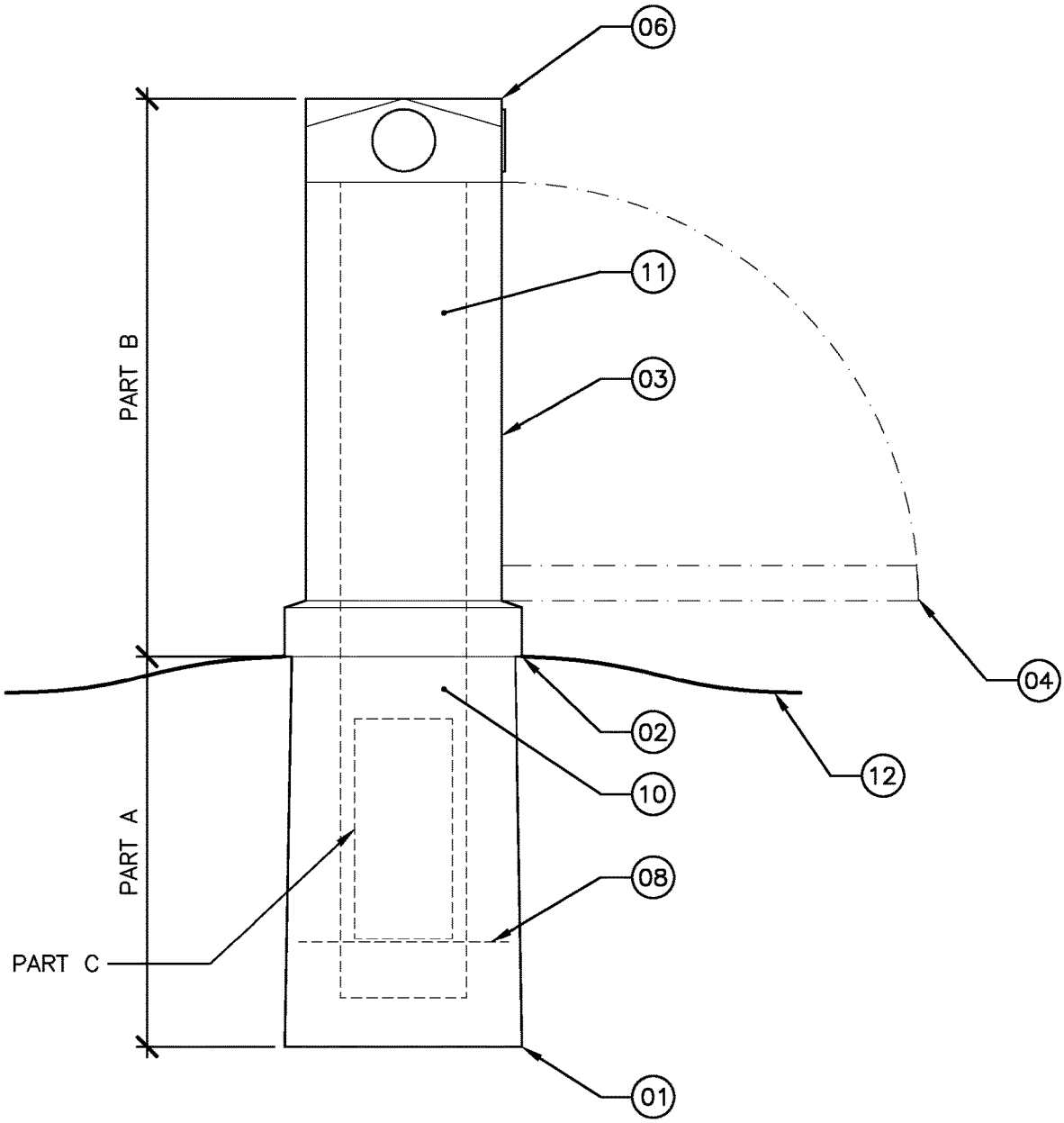
FIG. 9 is a right side view of the exemplary headstone and foundation structure of FIGS. 1, 3, 5, 7 and 8, wherein grade or ground level is shown.
Figure 10:
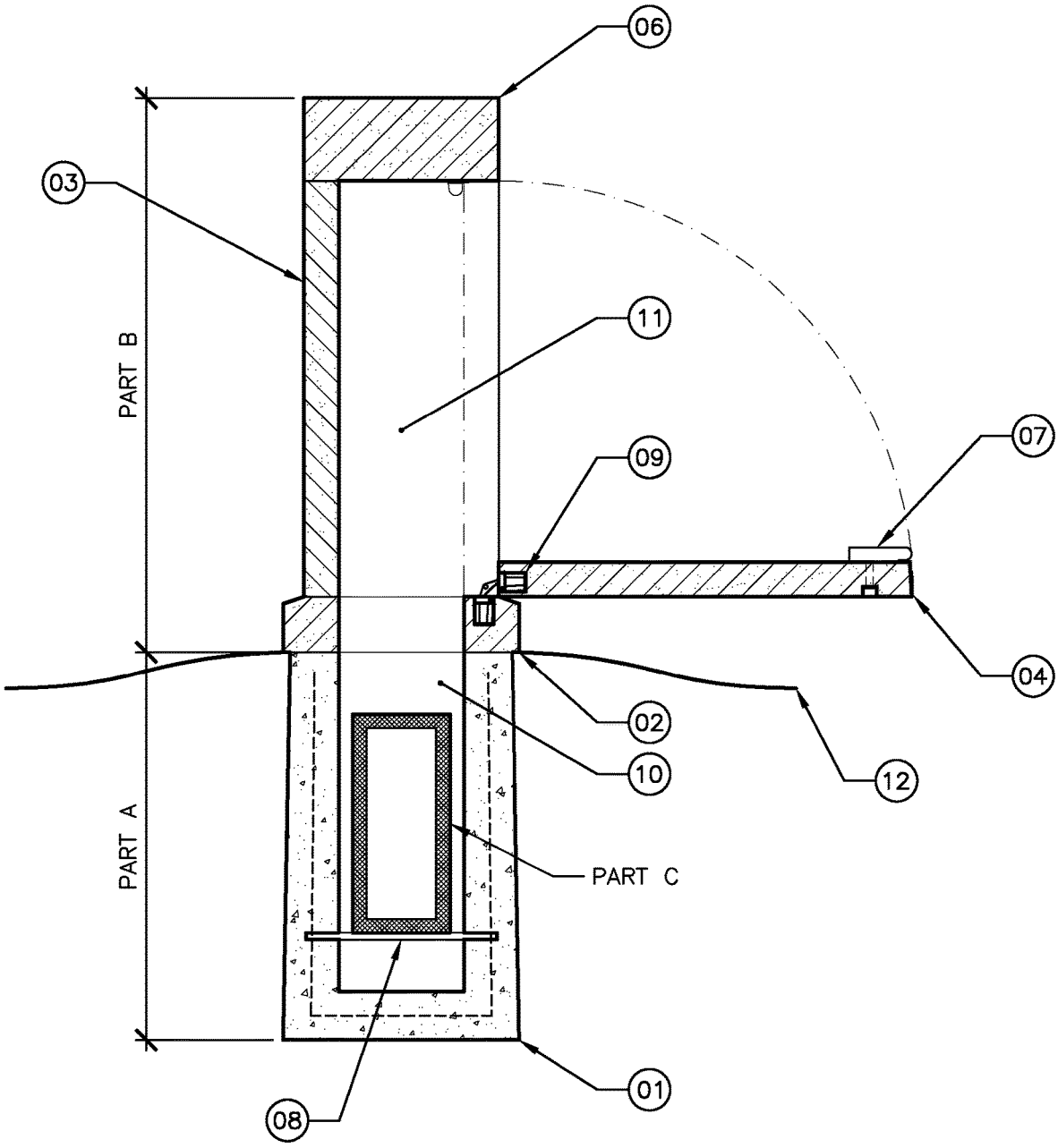
FIG. 10 is a right side section view cut through a vertical plane centered in the lateral direction of the exemplary headstone and foundation structure of FIGS. 1, 3, 5, and 7 to 9, wherein grade or ground level is shown.
Figure 11:
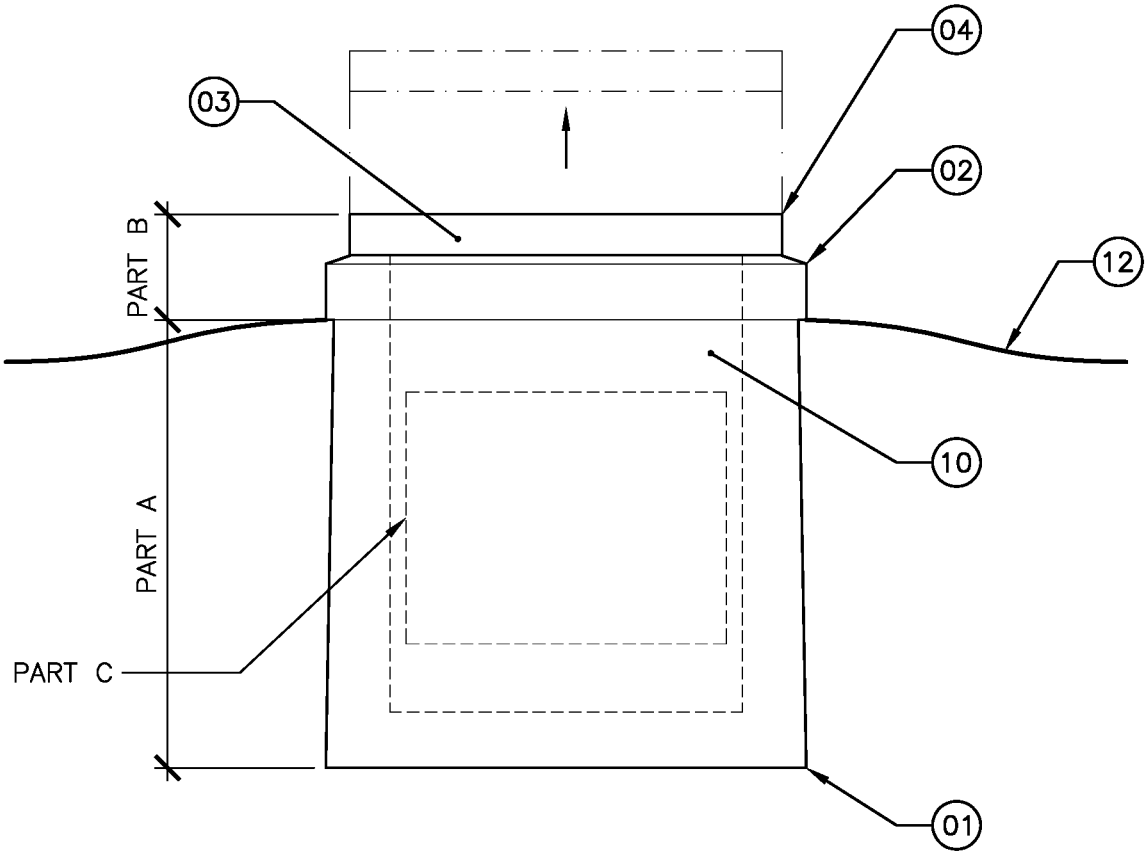
FIG. 11 is a front side view of the exemplary footstone and foundation structure of FIGS. 2, 4, and 6, wherein grade or ground level is shown.
Figure 12:
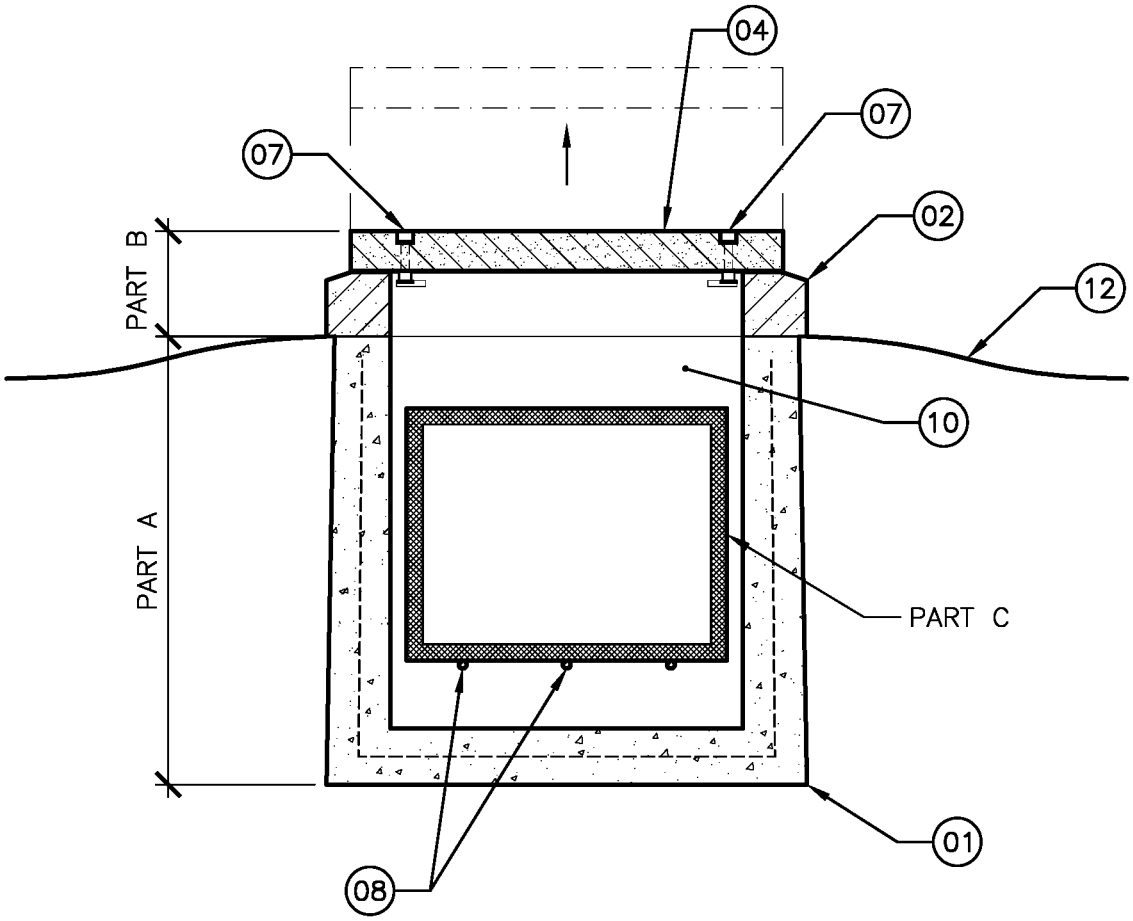
FIG. 12 is a rear section view cut through a vertical plane centered in the forward/rearward direction of the exemplary footstone and foundation structure of FIGS. 2, 4, 6, and 11, wherein grade or ground level is shown.
Figure 13:
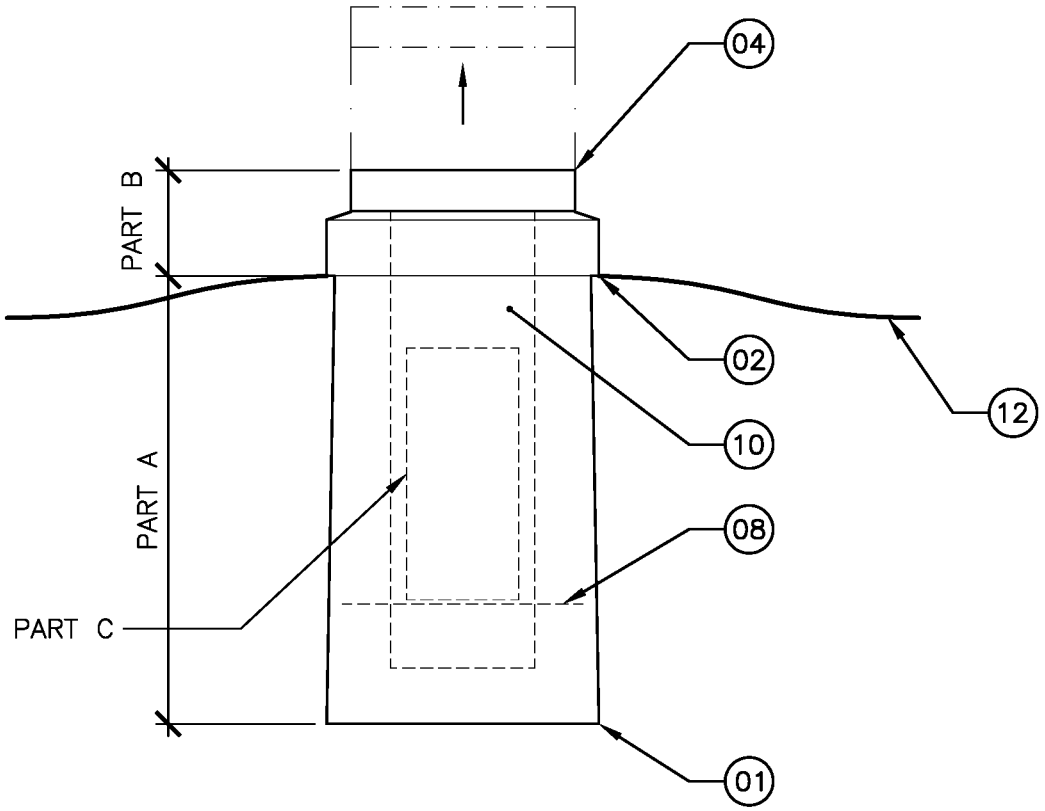
FIG. 13 is a right side view of the exemplary footstone and foundation structure of FIGS. 2, 4, 6, 11, and 12, wherein grade or ground level is shown.
Figure 14:
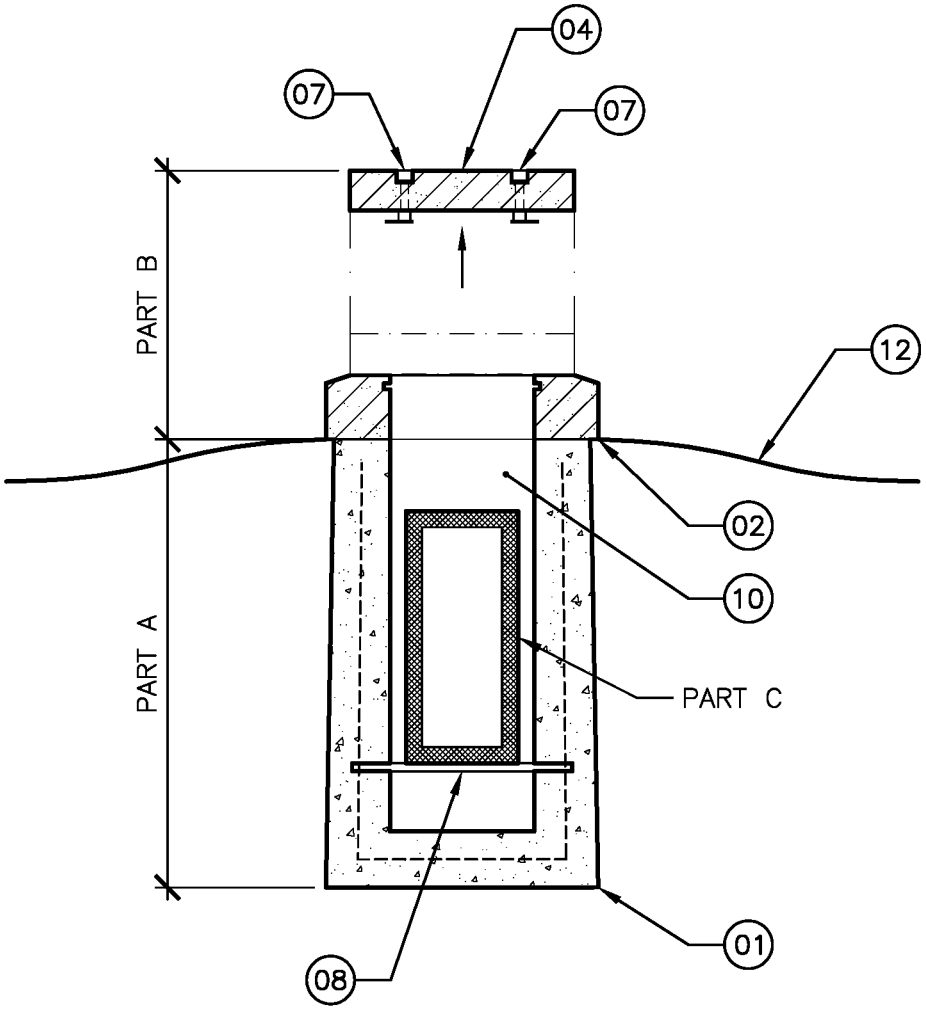
FIG. 14 is a right side section view cut through a vertical plane centered in the lateral direction of the exemplary footstone and foundation structure of FIGS. 2, 4, 6, and 11 to 13, wherein grade or ground level is shown.

It should be understood that the appended drawings are not necessarily to scale, presenting a somewhat simplified representation of various preferred features illustrative of the basic principles of the invention. The specific design features of the various memorialization grave marker systems as disclosed herein, including, for example, specific dimensions, orientations, locations, and shapes will be determined in part by the particular intended application and use environment. Certain features of the illustrated embodiments may have been enlarged or distorted relative to others to facilitate visualization and clear understanding. In particular, thin features may be thickened, for example, for clarity or illustration. All references to direction and position, unless otherwise indicated, refer to the orientation of the structures illustrated in the drawings. In general, up or upward generally refers to an upward direction within the plane of the page in FIGS. 1 and 2 and down or downward generally refers to a downward direction within the plane of the page in FIGS. 1 and 2. Also in general, fore or forward generally refers to a direction out the plane of the page in FIGS. 1 and 2 and aft or rearward generally refers to a direction into the plane of the page in FIGS. 1 and 2.

DETAILED DESCRIPTION OF CERTAIN PREFERRED EMBODIMENTS

It will be apparent to those skilled in the art, that is, to those who have knowledge or experience in memorialization grave marker system area of technology, that many uses and design variations are possible for the systems, devices, methods disclosed herein. The following detailed discussion of various alternative and preferred embodiments will illustrate the general principles of the invention with regard to the specific applications of headstones and footstones. Other embodiments suitable for other applications will be apparent to those skilled in the art given the benefit of this disclosure.

Referring now to FIGS. 1 to 14, a memorialization grave marker system for a grave according to the present invention is shown. The Illustrated memorialization grave marker system includes a lower or foundation portion (Part A) at least partially below grade or ground, an upper or grave marker portion (headstone, footstone or similar item) (Part B) supported by the foundation portion at least partially above ground. At least one of the foundation portion and the grave marker portion form an internal cavity, and at least one weather-tight container or "time capsule" (Part C) is concealed within the internal cavity for storing at least one of artifacts, memorabilia, and information accessible to present and future generations. In most U.S. locations, the memorialization grave marker system can be of any design or construction that is approved by the burial location (typically a cemetery).

FIGS. 1, 3, 5, and 7 to 10 illustrate a first embodiment of the present invention. The illustrated lower or foundation portion (Part A) includes a foundation or supporting structure (1) located entirely below grade or ground (12) and a base portion (2) supported on top of the foundation structure (1) and located entirely above grade or ground. (12). The illustrated foundation structure (3) is rectangular shaped having a bottom wall, a front wall extending upward from a front edge of the bottom wall, a rear wall extending upward from a rear edge of the bottom wall, a right-side wall extending upward from a right edge of the bottom wall and connected right edges of the front and rear walls, and a left-side wall extending upward from a left edge of the bottom wall and connected left edges of the front and rear walls. The walls form an interior void area or hollow interior cavity (10) open at its top and centrally located within the foundation structure (1). The interior void area or hollow interior cavity (10) is sized and shaped to receive the weather-tight container or "time capsule" (Part C) and/or any other objects allowed by the burial location including vessel(s) containing cremated remains of others). The illustrated foundation structure (1) is formed of reinforced concrete but alternatively can be formed any other one or more other decay resistive materials such as, for example but not limited to, concreate, stone, metals, masonry, treated wood, plastics, etc. suitable for supporting the grave marker portion (Part B).

The illustrated base portion (2) has the shape of a rectangular frame with a rectangular-shaped interior opening. The base portion (2) is sized to rest on top of the front, rear, right and left walls of the foundation structure (1) with the rectangular-shaped interior opening extending the interior void area or hollow interior cavity (10) in the upward direction. The top surface of the base portion (2) is configured to support the grave marker portion (Part B) thereon. The illustrated base portion (2) is formed of granite but alternatively can be formed any one or more other decay resistive materials such as, for example but not limited to, concrete, stone, metals, masonry, treated wood, plastics, etc. suitable for supporting the grave marker portion (Part B). It is noted that the base portion (2) can alternatively be integrally part of the grave marker portion (Part b) in a one-piece construction if desired or eliminated if not desired.

The illustrated foundation portion is provided with at least one support (8) for elevating the weather-tight container or "time capsule" (Part C) above the bottom of the cavity (11) so that reaching in to retrieve the "Time Capsule" (Part C) could be easier. The illustrated at least one support (8) includes a plurality of parallel and spaced apart horizontally-extending rods. The plurality of rods extend between the front and rear walls and are cast into the front and rear walls. The size (height, width & length) of the void (10) in the foundation portion (Part A), and the placement of the at least one support (8) is intended to be coordinated with the dimensions of the weather-tight container or "time capsule" (Part C) and the design of the grave marker portion (Part B). It is noted that the at least one support can alternatively have any other suitable quantity, configuration, and/or location.

It is noted that the foundation portion (Part A) can be designed to be any suitable size, shape, color(s), can be built from any combination of decay resistive materials (such as, for example but not limited to, concrete, stone, metals, masonry, treated wood, plastics, etc.), suitable for the purpose of supporting the grave marker portion (Part B), and can be constructed in any manner allowed by the governing authorities of the burial location and to enable it to be integrated with the grave marker portion (Parts B) and the weather-tight container or "time capsule" (Part C). It is also noted that the foundation portion (Part A) can alternatively be formed solid (that is, without the interior void area or hollow interior cavity (10)) if the grave marker portion (Part B) is configured to receive the entire weather-tight container or "time capsule" (Part C) (that is, the entire interior void area or hollow interior cavity (11) is located within the upper or grave marker portion (Part B).

The upper or grave marker portion (Part B) of the illustrated memorialization grave marker system includes a visible headstone, footstone or similar device (3) that is exposed entirely above grade (12) and supported on top of the foundation portion (Part A). The illustrated headstone/footstone (3) is rectangular shaped having a top wall or cap, a front wall extending downward from a front edge of the top wall, a rear wall extending downward from a rear edge of the top wall, a right-side wall extending downward from a right edge of the top wall and connected right edges of the front and rear walls, and a left-side wall extending downward from a left edge of the top wall and connected left edges of the front and rear walls. The walls form an interior void area or hollow interior cavity (11) open at its bottom and centrally located within the headstone/footstone (3) so that the interior void area or hollow interior cavity (11) aligns with the interior void area or hollow interior cavity (10) of the foundation portion (Part A). The interior void are or hollow interior cavity (11) is sized and shaped to receive the weather-tight container or "time capsule" (Part C) and/or any other objects allowed by the burial location including vessel(s) containing cremated remains of others) and to allow access to the interior void area or hollow interior cavity (10) in the foundation portion (Part A). The outer or exposed side of the illustrated front wall is provided with a marking surface (5) for marking (typically engraved or cast in metal) desired indicia to identify the deceased such as, for example but not limited to, name, birthdate, death date etc. The illustrated headstone/footstone (3) is formed of a stone but alternatively can be formed any other one or more other decay resistive materials such as, for example but not limited to, concrete, stone, metals, masonry, treated wood, plastics, etc. The illustrated headstone/footstone (3) is also configured to be sealed from intrusion by the elements (moisture), insects, and pests (as known in the extermination industry).

The illustrated headstone/footstone (3) is configured to selectively allow access to the interior void areas or hollow interior cavities (10, 11) to authorized individuals with an access door or panel (4). The illustrated access panel (4) is formed by the front wall which is provided a pair of spaced apart interior hinges (9) at its lower end to secure the front wall to the base portion (2) of the foundation portion (Part A). The top of the illustrated front wall is provided with an interior latch or locking device (7) to selectively secure the top of the front wall to the top wall or cap. The illustrated latch (7) s secured to the inner side of the front wall and has a pivoting lever that is selectively pivoted by a key (not shown) into or out of a slot formed in the bottom of the top wall or cap to selectively lock or unlock the access panel (4) to the top wall or cap. The illustrated latch (7) includes a small opening or key hole extending through the front wall so that the key can be inserted through the front panel to the interior latch (7) to lock or unlock the latch (7). A keyhole cover (not shown) is preferably provided to conceal the keyhole and to further conceal the latch (7). It is noted that the latch (7) can alternatively have any other suitable location and/or configuration. Configured in the manner the access panel (4) as well as the interior void areas or hollow interior cavities (10, 11) are concealed from view to resist access by anyone not intended or authorized to have access to the interior void areas or hollow interior cavities (10,11). The access panel (4) is sized and configured so that the sealed weather-tight container(s) or "time capsule" (Part C) can be inserted the opening and into the interior void areas or hollow interior cavities (10, 11) and removed from the interior void areas or hollow interior cavities (10,11) and the opening. It is noted that the access panel (4) can alternatively have any other suitable configuration such as, for example but not limited to, a sliding panel, a removable panel, a removable panel secured by mechanical fasteners, and the like. It is also noted that the access panel (4) can alternatively have any other suitable location such as, for example but not limited to, the top wall or cap, the rear wall, the left or right side wall or the like.

It is noted that the grave marker portion (Part B) is designed to be any suitable size, shape, color(s), can be built from any combination of decay resistive materials such as, for example but not limited to, concrete, stone, metals, masonry, treated wood, plastics, etc., suitable for the purpose of marking the grave, and can be constructed in any manner allowed by the governing authorities of the burial location and to enable it to be integrated with the grave foundation portion (Parts A) and the weather-tight container or "time capsule" (Part C). It is also noted that the grave marker portion (Part B) can alternatively be formed solid (that is, without the interior void area or hollow interior cavity (11)) if the foundation portion (Part A) is configured to receive the entire weather-tight container or "time capsule" (Part C) (that is, the entire interior void area or hollow interior cavity (11) is located within the lower or foundation portion (Part A). It is further noted that the grave marker portion (Part B) can be designed to perform other functions, such as having a vessel for cut flowers or plants, a bench, a statue, a religious symbol, or similar devices.

In the illustrated memorialization grave marker system, the integration of the lower or foundation portion (Part A) and the upper or grave marker portion (Part B) is in a vertically-stacked configuration, with the lower or foundation portion (Part A) located below grade or the ground surface (12) for supporting the grave marker portion (Part B) above grade or the ground surface (12). The thicknesses of the walls and reinforcement of the foundation structure (1) of the foundation portion (Part A) are engineered to resist all forces (such as lateral and vertical loads, water table uplift, tension, compression and moment forces) that may act on it. The details and materials of the construction of the foundation portion (1), including waterproofing coatings, fasteners and connectors of any kind and sealants or adhesives of any kind are engineered to resist all forces (such as lateral loads, water table uplift, tension, compression and moment forces) that may act on it and are also to be configured and suitable to resist the intrusion of moisture, insects, and pests of any kind.

The thickness, shape, and form of the walls, and the access panel (4) of the headstone/footstone (3) of the upper or grave marker portion (B), and the methods and details for connecting of these elements to each other and to the lower or foundation portion (Part A), are engineered to resist all forces (such as, for example but not limited to, lateral and vertical loads, wind uplift, minor impact, tension, compression and moment forces) that may act on it and as required to resist intrusion of moisture, insects and pests of any kind and as approvable by the governing authorities of the burial location. All forms of joinery, mechanical fasteners, metal connecting devices, adhesives, locking devices, closures, gaskets, sealants, etc. are utilized in the engineering and fabrication of the headstone/footstone as required by the design features to be incorporated in the upper or grave marker portion (Part B) are to be resistive to decay, damage and deterioration from expansion and contraction, all types of weather, freeze thaw cycling, minor impacts, etc. and infiltration of moisture, insects, and pests.

The weather-tight container or "time capsule" (Part C) may be purchased or fabricated as required to provide a sealed weather-tight container(s) (sealed from intrusion of both air & water) and to act as a personal "time capsule" for the artifacts memorabilia and information intended to be stored the interior void areas or hollow interior cavities (10, 11) within the lower or foundation portion (Part A) and/or the upper or grave marker portion (Part B). The weather-tight container or "time capsule" (Part C) may can also be any size, shape, color(s) and can be built from any combination of weather and decay resistive materials (such as, for example but not limited to, metals, glass, plastics, etc.), that are compatible with the materials forming the interior void areas or hollow interior cavities (10, 11) in the lower or foundation portion (Part A) and the upper or grave marker portion (Part C) and suitable for the purpose of acting as the "time capsule" or container(s) and in accordance with published guidelines for the preservation of materials and the IP rating system for moisture and air intrusion of storage containers.

FIGS. 2, 4, 6, and 11 to 14 illustrate a second embodiment of the present invention. The illustrated second embodiment of the invention is substantially the same as the first embodiment except for the construction of the upper grave marker portion (Part B) such that only the lower or foundation portion (Part A) forms the interior void area or hollow interior cavity (11) and the attachment of the access door (4). The illustrated grave marker portion (Part B) includes a headstone/footstone (3) having only a top wall to form a cap or lid for the base portion (2) of the foundation portion (Part B). The upper or exposed side of the illustrated headstone/footstone (3) is provided with a marking surface (5) for marking (typically engraved or cast in metal) desired indicia to identify the deceased such as, for example but not limited to, name, birthdate, death date etc. The illustrated headstone/footstone (3) is formed of granite but alternatively can be formed any other one or more other decay resistive materials such as, for example but not limited to, concrete, stone, metals, masonry, treated wood, plastics, etc. The illustrated headstone/footstone (3) is also configured to be sealed from intrusion by the elements (moisture), insects, and pests (as known in the extermination industry).

The illustrated access panel (4) is formed by the entire headstone/footstone (3) which is provided with four interior latches or locking devices (7) at its lower side, one near each of the corners, to selectively secure the headstone/footstone (3) to the base portion (2) of the foundation portion (Part A). When the latches (7) are locked, the headstone/footstone (3) is secured to the base portion (2) of the foundation portion (Part A). When the latches (7) are un locked, the headstone/footstone (3) can be lifted entirely off of the base portion (2) of the foundation portion (Part A). The illustrated locking devices (7) each include a small opening or keyhole extending through the headstone/footstone (3) to access the interior latch or locking device (7) with a key (not shown). Keyhole covers (not shown) are preferably provided to conceal the keyhole and to further conceal the latches (7). It is noted that the latches (7) can alternatively have any other suitable location and/or configuration. Configured in the manner the access panel (4) as well as the interior void area or hollow interior cavity (10) are concealed from view to resist access by anyone not intended or authorized to have access to the void (10)). It is also noted that the access panel (4) can alternatively have any other suitable configuration such as, for example but not limited to, a sliding panel, a hinged panel, a removable panel secured by mechanical fasteners, and the like. The access panel (4) is sized and configured so that the sealed weather-tight container(s) or "time capsule" (Part C) can be inserted into the void (10) and removed from the void (10).

It should be appreciated from the above disclosure that the memorialization grave marker system of the present invention can be obtained by retrofitting an existing grave markers at burial locations by replacement of or alteration to existing parts, or any combination thereof. It should also be appreciated from the above disclosure that the grave marker memorialization system of the present invention can be obtained by combining any or all of the Parts A, B, as C as a single assembly, where Part A and Part C, or Part A and Part B, or Part B and Part C, or Parts C, B, & A, are fabricated (or 3D printed) as a single object. It should further be appreciated from the above disclosure that the advantages of the present invention include, without limitation, the ability to securely save and secure memorabilia, artifacts and information about themselves, a deceased relative or associate (or even a pet) for long periods of time at the location that they are intended and have designated to be memorialized for perpetuity, in order to educate and/or develop an understanding or connection with descendants, associates, scholars, biographers, friends, family or approved interested party, for present or later generations.

It is noted that each of the features of the various disclosed embodiments of the present invention can be utilized in any combination with each of the other disclosed embodiments of the present invention.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

What is claimed is:

1. A grave marker system comprising, in combination:
a foundation portion at least partially below ground;
a grave marker portion supported by the foundation portion at least partially above ground;
at least one weather-tight container located within the internal cavity for storing at least one of artifacts, memorabilia, and information; and
at least one support supporting the at least one weather-tight container above a bottom of the internal cavity;
wherein both the foundation portion and the grave marker portion form the internal cavity and wherein the at least one support includes a plurality of parallel and spaced apart horizontally-extending rods.

2. The grave marker system according to claim 1, wherein the internal cavity and the at least one weather-tight container located therein are each concealed.

3. The grave marker system according to claim 1, wherein at least one of the foundation portion and the grave marker portion includes an access panel selectively openable to provide access to the internal cavity.

4. The grave marker system according to claim 3, wherein the grave marker portion includes the access panel.

5. The grave marker system according to claim 3, wherein the access panel has at least one concealed hinge for opening and closing the access panel.

6. The grave marker system according to claim 3, wherein the access panel has at least one concealed locking device to control access to the internal cavity.

7. The grave marker system according to claim 6, wherein the access panel has a plurality of concealed locking devices to control access to the internal cavity.

8. A grave marker system comprising, in combination:
a foundation at least partially below ground;
a headstone supported by the foundation above ground;
wherein both the foundation and the headstone form an internal cavity;
wherein the headstone includes an access panel selectively openable to provide access to the internal cavity; and
at least one weather-tight container for storing at least one of artifacts, memorabilia, and information located within the internal cavity;
at least one support supporting the at least one weather-tight container above a bottom of the internal cavity; and
wherein the at least one support includes a plurality of parallel and spaced apart horizontally-extending rods.

9. The grave marker system according to claim 8, wherein the internal cavity and the at least one weather-tight container located therein are each concealed.

10. The grave marker system according to claim 8, wherein a front panel of the headstone forms the access panel.

11. The grave marker system according to claim 8, wherein the access panel has at least one locking device to control access to the internal cavity.

12. A grave marker system comprising, in combination:
a foundation at least partially below ground;
a footstone supported by the foundation above ground;
wherein the foundation forms an internal cavity;
wherein footstone includes an access panel selectively openable to provide access to the internal cavity; and
at least one weather-tight container for storing at least one of artifacts, memorabilia, and information located within the internal cavity,
at least one support supporting the at least one weather-tight container above a bottom of the internal cavity;
wherein the at least one support includes a plurality of parallel and spaced apart horizontally-extending rods, and wherein the access panel has at least one locking device to control access to the internal cavity.

13. The grave marker system according to claim 12, wherein the internal cavity and the at least one weather-tight container located therein are each concealed.

14. The grave marker system according to claim 12, wherein the entire footstone forms the access panel.

* * * * *